US006213683B1

(12) United States Patent
Muramatsu

(10) Patent No.: US 6,213,683 B1
(45) Date of Patent: Apr. 10, 2001

(54) FLEXIBLE FILM WEIR

(75) Inventor: Tateo Muramatsu, Yokohama (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/227,590

(22) Filed: Jan. 8, 1999

(30) Foreign Application Priority Data

Jan. 14, 1998 (JP) ..... 10-005393

(51) Int. Cl.[7] ..... E02B 7/20
(52) U.S. Cl. ..... 405/115; 405/90; 405/91
(58) Field of Search ..... 405/115, 90, 91

(56) References Cited

U.S. PATENT DOCUMENTS

| | | | | |
|---|---|---|---|---|
| 3,173,269 | * | 3/1965 | Imbertson | 405/115 |
| 3,246,474 | * | 4/1966 | Mesnager | 405/115 |
| 4,279,540 | * | 7/1981 | Suga et al. | 405/115 |
| 4,299,514 | * | 11/1981 | Muramatsu et al. | 405/115 |
| 4,314,744 | * | 2/1982 | Tsuji et al. | 405/115 |
| 4,498,810 | * | 2/1985 | Muramatsu et al. | 405/115 |
| 5,067,851 | * | 11/1991 | Fujisawa et al. | 405/115 |
| 5,388,928 | * | 2/1995 | Kumagai | 405/115 |

FOREIGN PATENT DOCUMENTS

| | | | | |
|---|---|---|---|---|
| 954935 | | 4/1964 | (GB) . | |
| 2035427 | * | 6/1980 | (GB) | 405/115 |
| 1 602 335 | | 11/1981 | (GB) . | |
| 2 180 579 | | 4/1987 | (GB) . | |
| 2180579 | * | 4/1987 | (GB) | 405/115 |
| 0111515 | * | 8/1980 | (JP) | 405/115 |
| 0037212 | * | 3/1983 | (JP) | 405/115 |
| 62-45811 | | 2/1987 | (JP) . | |
| 0055311 | * | 3/1987 | (JP) | 405/115 |
| 0122812 | * | 5/1988 | (JP) | 405/115 |
| 406033434A | * | 2/1994 | (JP) | 405/115 |
| 10-96225 | | 4/1998 | (JP) . | |

* cited by examiner

*Primary Examiner*—William Neuder
*Assistant Examiner*—Alexandra K. Pechhold
(74) *Attorney, Agent, or Firm*—Oliff & Berridge, PLC

(57) ABSTRACT

A flexible film, of which a flexible film weir is composed, has a two-dimensional configuration when expanded, and the total length of the periphery of the flexible film is set longer than the mounting length of mounting faces (a river bed and faces of slopes). Weights are attached on the flexible film at appropriate intervals. Portions left redundant when the flexible film is mounted on the mounting faces are folded and fixed at toes of the slopes in such a way that they are overlapped. The two-dimensional configuration of the flexible film simplifies the structure. Further, as the weights prevents the weir from floating up, there is no need for forming irregularities on the river bed, thereby simplifying the construction.

19 Claims, 9 Drawing Sheets

FLEXIBLE FILM WEIR

BACKGROUND OF THE INVENTION

1. Field of the Invention

The present invention relates to a flexible film weir formed of a flexible film and laid across a river or the like, which is erected when air or a liquid such as water is supplied and falls flat when air or a liquid such as water is discharged.

2. Description of the Related Art

Water gates, weirs for protecting a lake and the like are generally made of steel and are large-scale installations.

Thus, one which is generally referred to as a "rubber weir" wherein a flexible film weir is erected and laid flat by supplying and discharging air or liquid such as water is often used for a river because its construction is easy. A weir of this kind can also be used as a water gate or a weir for protecting a lake.

Unlike one that is provided in the middle of the river, however, in a water gate or a weir for protecting a lake, the water levels of both sides of it may sometimes be reversed. Thus, water gates and weirs for protecting a lake need to stay erected with stability in all circumstances.

Additionally, as a water gate or a weir is opened when the water levels of both sides of it are equal, it is desirable that the flexible film weir falls completely flat when the water levels of both sides of it are equal.

However, if air is used, the film may be partially floated by the air that is trapped in the bag-like body when the weir falls flat, or some portions of the film do not come into close contact with the river bed even when the air is not trapped inside. The floating part and portions that are not in close contact with the river bed float in the water, thereby making it difficult to lay the flexible film weir completely flat.

Particularly, when the weir is provided in thoroughfares used by shipping, in some cases the portions floating in the water may come into contact with the bottom of a vessel.

In order to solve the aforementioned problems, Japanese Patent Application Laid-Open (JP-A) No. 62-45811 discloses forming irregularities on the river bed or mounting objects for forming irregularities (for example, tubes, sticks, or the like) on the river bed. However, the labor required to form irregularities or the cost of the objects for forming irregularities raises the problem of high cost.

Further, a flexible film weir of this type requires a structure to absorb the redundant length thereof as its configuration changes in accordance with the supply and discharge of the air. Thus, the concern exists that the structure may become complicated.

SUMMARY OF THE INVENTION

With the aforementioned in view, an object of the present invention is to provide a flexible film weir with a simple structure and construction procedure.

A first aspect of the present invention is a flexible film weir consisting of a flexible film, which is mounted on a bottom face and on faces of slopes situated on both sides of the bottom face, extends transversely from one slope face to the other slope face, and is erected and laid flat as liquid is supplied thereto and discharged therefrom, characterized in that: the flexible film has a two-dimensional configuration when expanded, and the total length of the periphery of the flexible film is set longer than the mounting length of mounting portions of the bottom face and faces of slopes; and portions that are left redundant when the flexible film is mounted on the mounting positions are folded and fixed at toes of slopes in such a way that they are overlapped.

In the flexible film weir of the first aspect of the present invention, as the total length of the periphery of the flexible film is set longer than the mounting length of the mounting portions of the bottom face and the faces of slopes, some portions are left redundant when the flexible film is mounted on the mounting portions. The redundant portions are folded and fixed at the toes of slopes in such a way that they are overlapped, which fixes all the peripheral parts of the flexible film on the bottom face and both faces of slopes, thereby sealing the inside.

As the total length of the periphery of the flexible film is set longer than the mounting length of the mounting portions of the bottom face and the faces of slopes, the weir is able to stand erect when air or the like is supplied inside. Further, as the configuration of the flexible film is two-dimensional when expanded, it has an excellent effect in that the structure and construction is simplified.

A second aspect of the present invention is a flexible film weir consisting of a flexible film, which is mounted on a bottom face and on faces of slopes situated on both sides of the bottom face, extends transversely from one slope face to the other slope face, and is erected and laid flat as liquid is supplied thereto and discharged therefrom, comprising: the flexible film whose configuration at the time of expansion is two-dimensional; a pair of first mounting edges which extend in parallel with each other along one direction; and a pair of second mounting edges which are provided successively in the longitudinal direction of both of the end portions of the first mounting edges and whose end portions opposite to those connected to the first mounting edges are directly or indirectly connected to each other, characterized in that: the pair of second mounting edges are mounted along a pair of second lines which are provided on the faces of slopes, each of which is set with the same length as the second mounting edges when the flexible film is disposed on a plane, and whose angles are set narrower than those made by the pair of second mounting edges; and the pair of first mounting edges are mounted along a pair of first lines which are provided on the bottom face, each of which is set by being extended to the point of intersection with the second mounting edge when the flexible film is disposed on a plane, and which is set with a shorter distance than the distance of the pair of first mounting edges and extends in parallel with each other in the transverse direction so that redundant portions of the first mounting edges which go beyond the first lines are converged and mounted around toes of slopes in such a way that they are overlapped.

The configuration of the flexible film weir composed of the flexible film changes when it is laid flat and when it is erected. Therefore, it is necessary to install the weir with the slack for supplying air or the like inside so that the weir is erected.

In the flexible film weir of the first aspect using the flexible film whose configuration at the time of unfolding is two-dimensional, the flexible film includes the pair of first mounting edges which extend in parallel with each other along one direction, and the pair of second mounting edges which are provided successively in the longitudinal direction of both of the end portions of the first mounting edges and whose end portions opposite to those connected to the first mounting edges are directly or indirectly connected to each other.

And the pair of second mounting edges are mounted along the pair of second lines which are provided on the faces of slopes, each of which is set with the same length as the second mounting edges when the flexible film is disposed on a plane, and whose angles are set narrower than those of the pair of second mounting edges. Therefore, on the end portions in the longitudinal direction of the flexible film weir, that is, on the portions which are mounted on the faces of slopes, the slack of the flexible film is generated when laid flat, thereby enabling the flexible film weir to stand erect when air or the like is supplied inside.

In addition, the pair of first mounting edges are mounted along the pair of first lines which are provided on the bottom face, each of which is set by being extended to the point of intersection with the second mounting edge when the flexible film is disposed on a plane, and which is set with a shorter distance than the distance of the pair of first mounting edges and extends in parallel with each other in the transverse direction. Therefore, on the middle portions in the longitudinal direction of the flexible film weir, that is, on the portions which are mounted on the bottom face, the slack of the flexible film is generated when laid flat, thereby enabling the flexible film weir to stand erect when air or the like is supplied inside.

As the length of the first mounting edges is longer than the first lines, some portions of the first mounting edges are left redundant. However, the redundant portions of the first mounting edges which go beyond the first lines are converged and mounted around the toes of slopes in such a way that they are overlapped, which fixes all the peripheral parts of the flexible film on the bottom face and both faces of slopes, thereby sealing the inside.

The two-dimensional configuration of the flexible film at the time of expansion has an excellent effect in that the structure and construction is simplified.

A third aspect of the present invention is the flexible film weir of the second aspect, characterized in that said pair of second mounting edges are inclined in such a way that the end portions opposite to those connected to the first mounting edges approach each other.

In the flexible film weir of the third aspect of the present invention, the inclining edges are inclined toward the apexes of slopes. Therefore, there is no excessive periphery length and the redundant portions generated when the weir is erected and laid flat are small, which makes the appearance preferable. Further, as the radius of curvature is short and the structure is flat, it has an excellent effect in that the weir does not have to be excessively tall and the resulting low tension of a bag-like body provides safety.

A fourth aspect of the present invention is any of the flexible film weirs from the first to the third aspects, characterized in that weights with a heavier specific gravity than said flexible film are attached thereto.

In the flexible film weir of the fourth aspect, the total specific gravity is increased as weights with a heavier specific gravity than the flexible film are attached thereto. Therefore, it has an excellent effect in that the whole flexible film weir can be brought into close contact with the bottom face and the faces of slopes when the inside air is discharged. It is preferable that a plurality of weights are provided at appropriate intervals so that the flexible film does not partially float up.

A fifth aspect of the present invention is the flexible film weir of the fourth aspect, characterized in that the specific gravity of said flexible film including said weights is not less than 1.5.

In the flexible film weir of the fifth aspect, as the specific gravity of the flexible film including the weights is not less than 1.5, the weir sinks in the water more easily. Therefore, it has an excellent effect in that the whole flexible film weir is surely brought in close contact with the bottom face and the faces of slopes, thereby preventing part of the weir from floating up.

A sixth aspect of the present invention is the flexible film weir described in any of from the first to the fifth aspects, characterized in that a sealing sheet which has the same configuration as said flexible film and is thinner than said flexible film is disposed between the bottom face and said flexible film and between the faces of slopes and said flexible film so that the surrounding area of the periphery of said sealing sheet is in close contact with that of the periphery of said flexible film.

In the flexible film weir of the sixth aspect, as the sealing sheet which is thinner than the flexible film is disposed between the bottom face and the flexible film and between the faces of slopes and the flexible film so that the surrounding area of the periphery of the sealing sheet is brought into close contact with that of the periphery of the flexible film, a bag-like body is formed by the flexible film and the sealing sheet. Therefore, it has an excellent effect in that airtightness is improved, thereby ensuring prevention of leakage of the air supplied inside. Further, manufacture of the sealing seat is easy because it has a two-dimensional configuration just like the flexible film.

An seventh aspect of the present invention is the flexible film weir of the sixth aspect, characterized in that the surrounding area of the periphery of said sealing sheet and that of the periphery of said flexible film are nipped between the bottom face and metal fittings and between the faces of slopes and the metal fittings.

In the flexible film weir of the seventh aspect, the surrounding area of the periphery of the sealing sheet and that of the periphery of the flexible film are nipped between the bottom face and the metal fittings and between the faces of slopes and the metal fittings. Therefore, it has an excellent effect in that without using adhesive or the like, the surrounding area of the periphery of the sealing sheet can surely be brought into close contact with that of the periphery of the flexible film.

DESCRIPTION OF THE PREFERRED EMBODIMENTS

An embodiment of the flexible film weir of the present embodiment will be described in accordance with FIGS. 1 through 7.

Figure 1:
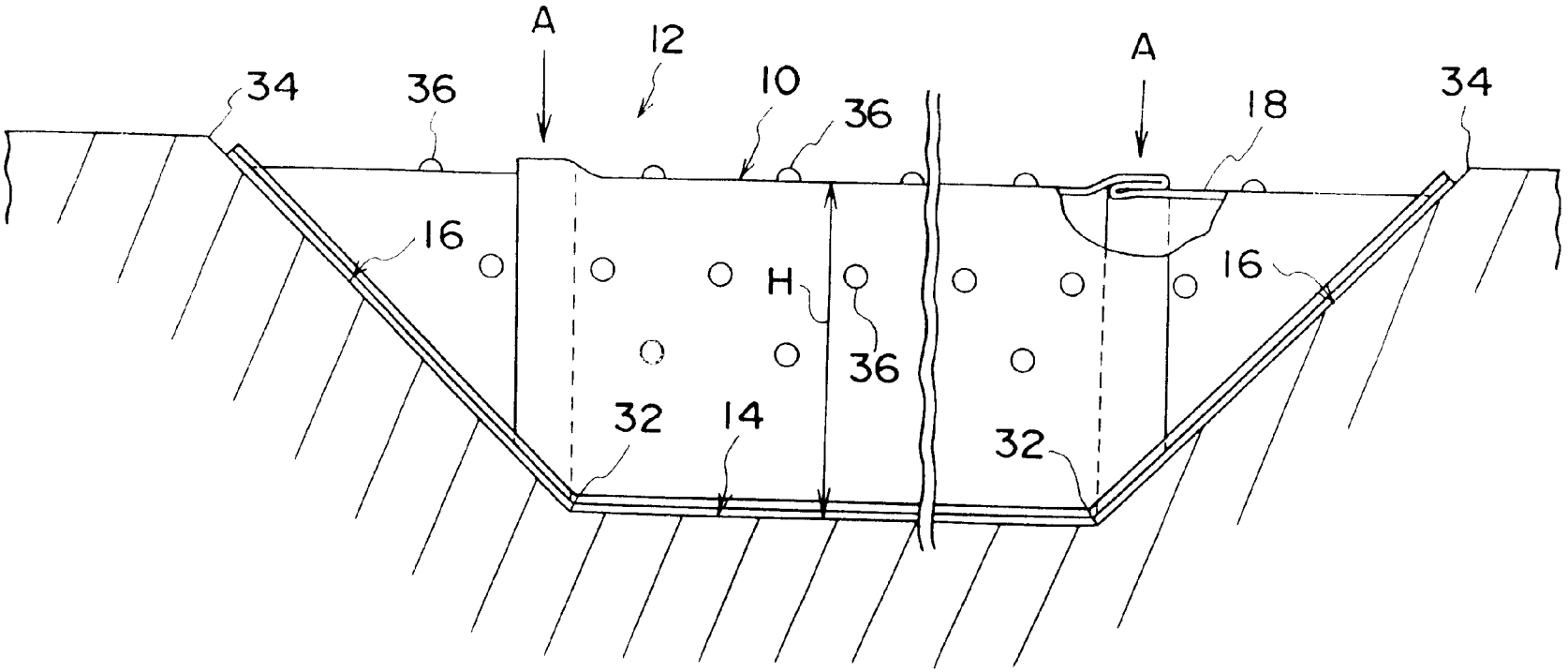
FIG. 1 is an elevational view illustrating an erected flexible film weir according to an embodiment of the present invention.

As shown in FIG. 1, a river bed 14 of a river 12 wherein a flexible film weir 10 of the present embodiment is constructed has a flat surface and the faces of slopes 16 situated on both sides of the river 12 are inclined to the river bed 14 at a certain angle (θ).

Figure 2:
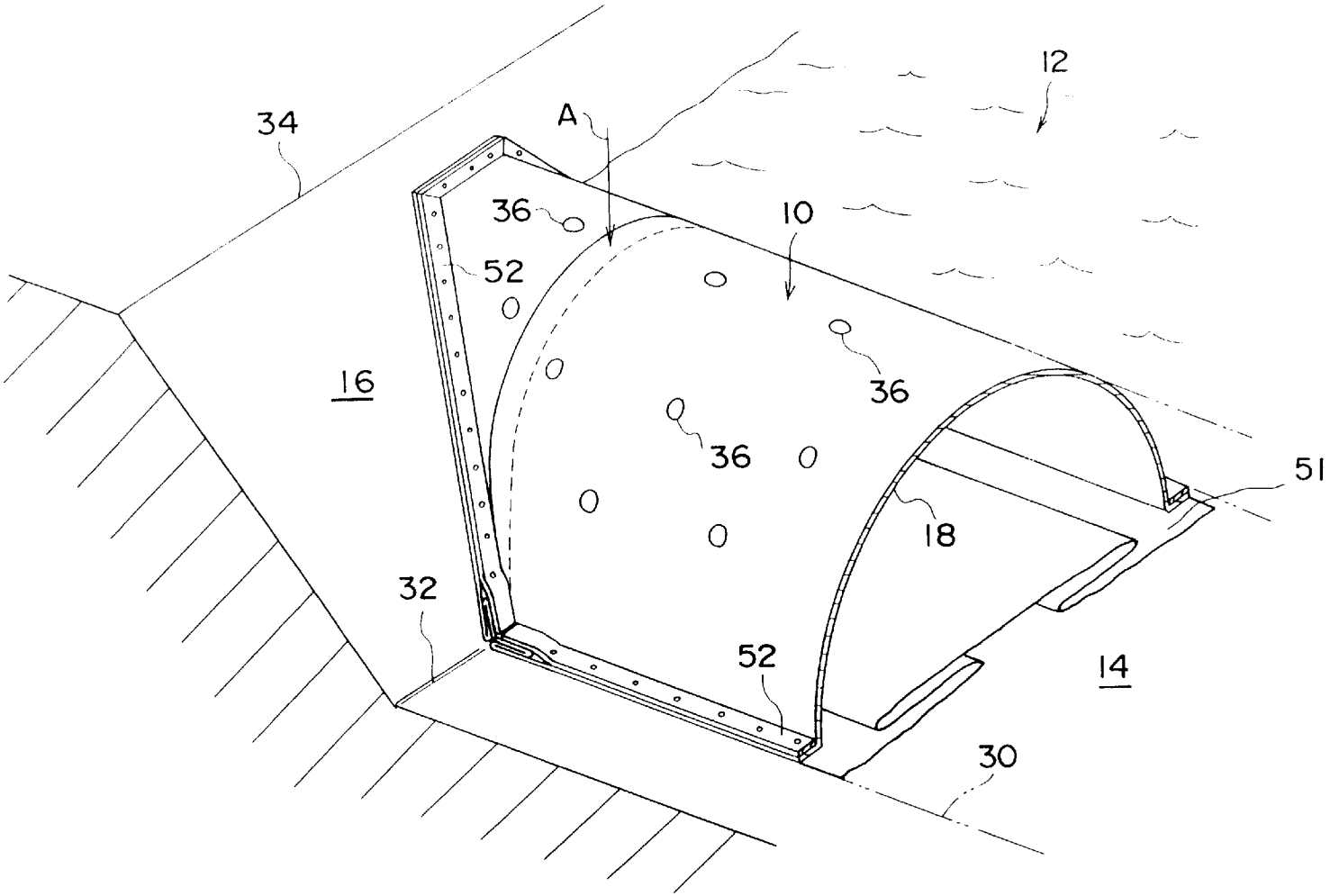
FIG. 2 is a perspective view illustrating part of an erected flexible film weir.

In the present embodiment, the river bed 14 and the faces of the slopes 16 are formed with concrete or the like. As shown in FIG. 2, the flexible film weir 10 includes a flexible film 18 (specific gravity 1.1) made of rubber or soft resin and having an inside reinforcing layer (not illustrated) formed from cord, woven fabric, or the like and. A bag-like chamber is formed inside when the periphery of the flexible film 18 is fixed on the faces of slopes 16 and the river bed 14, which allows the weir to be erected and laid flat with the supply and discharge of liquid (air in the present embodiment).

As shown in FIGS. 1 and 2, when air is supplied inside to erect the flexible film weir 10, the weir extends straight across the river 12 from one slope face 16 to the other slope face 16 with an approximately constant height H.

Figure 3:
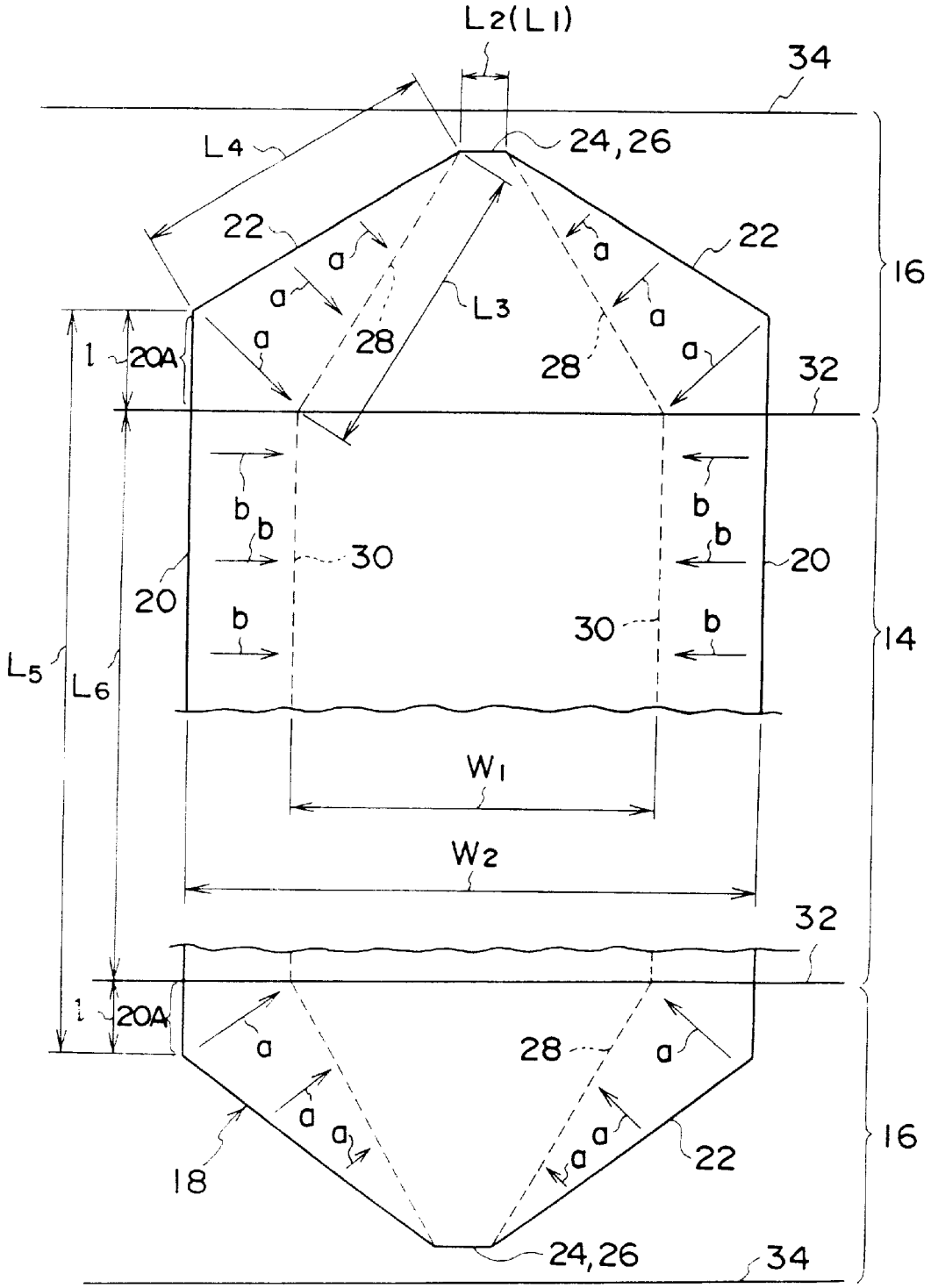
FIG. 3 is a plan view of a flexible film, a river bed, and faces of slopes.

FIG. 3 is a plan view illustrating the flexible film 18, the river bed 14 and the faces of slopes 16 expanded as a plan. The periphery of the flexible film 18 includes a pair of straight line edges 20 (first mounting edges of the present invention) which are aligned in parallel with each other, inclining edges 22 (second mounting edges of the present invention) which are connected to both ends of the straight line edges 20 and inclined inwardly to each other, and connecting end portions 24 which connect the ends of the inclining edges 22 that are not connected to the straight line edges 20 to the ends of the other inclining edges 22 that are not connected to the straight line edges 20.

Further, the dashed line shown in FIG. 3 illustrates a border of mounting positions of the river bed 14 and the faces of slopes 16 to which the periphery of the flexible film 18 is fixed. 26 are connection portion fixing lines along which the connecting end portions 24 of the flexible film 18 are disposed, 28 are inclining edge fixing lines (second lines of the present invention) along which the inclining edges 22 are disposed, 30 are straight line edge fixing lines (first lines of the present invention) along which the straight line edges 20 are disposed. In FIG. 3, the connecting portion fixing lines 26 are overlapped with the connecting end portions 24 of the flexible film 18.

Here, the connecting portion fixing lines 26 are in parallel with toes of slopes 32, and the length L1 of the connecting portion fixing lines 26 is equal to the length L2 of the connecting end portions 24 of the flexible film 18.

Next, two straight line edge fixing lines 30 are in parallel with each other, and their distance W1 is set shorter than the distance W2 between the straight line edges 20 of the flexible film 18.

Further, the length L5 of the straight line edges 20 is set longer than the length L6 of the straight line edge fixing lines 30 by length 21. It should be noted that the length l is determined in such a way that the height of the superior extremity of a portion placed on the face of slope 16 and the height of the superior extremity of a portion placed on the river bed 14 are almost equal when the flexible film weir 10 is erected (See FIG. 1).

Next, two inclining edge fixing lines 28 of the face of slope 16 are inclined inwardly to each other as they extend from the toe of slope 32 to the top of slope 34. One end of the inclining edge fixing line 28 is connected to one end of the straight line edge fixing line 30 and the other end of the inclining edge fixing line 28 is connected to one end of the connecting end portion 24. Further, the length L3 of the inclining edge fixing line 28 is equal to the length L4 of the inclining edge 22 of the flexible film 18.

In the flexible film weir 10 of the present embodiment, the connecting end portions 24 of the flexible film 18 are mounted along the connecting portion fixing lines 26 of the faces of slope 16, and the inclining edges 22 are drawn as shown by arrows a in FIG. 3 so that the inclining edges 22 are aligned with the inclining edge fixing lines 28.

Further, the straight line edges 20 of the flexible film weir 10 are drawn parallel toward the straight line edge fixing lines 30 as shown by arrows b in FIG. 3 so that the straight line edges 20 are aligned with the straight line edge fixing lines 30.

Figure 4B:
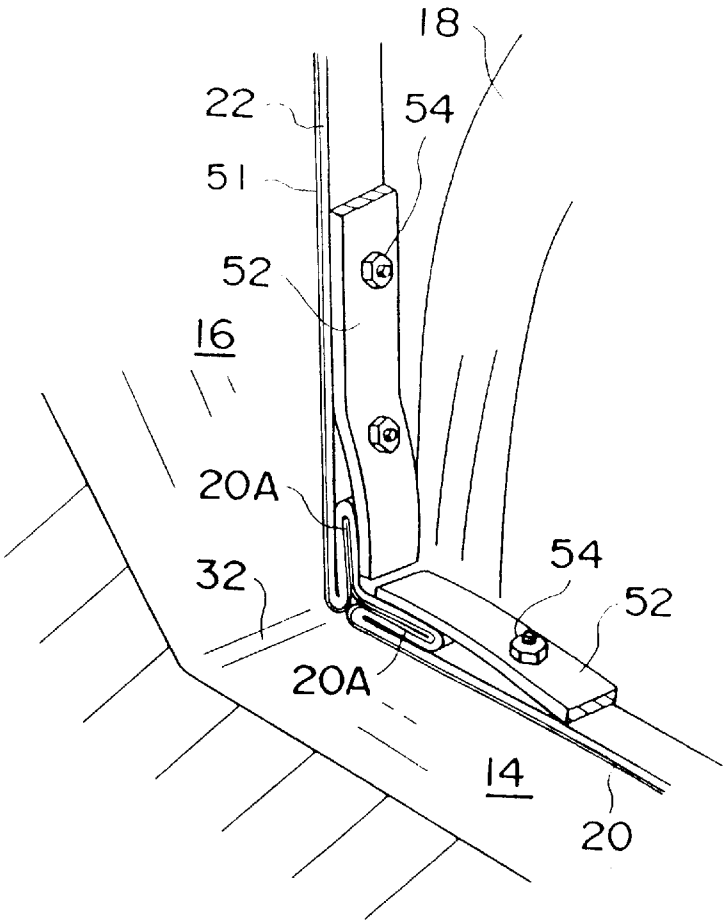
FIG. 4B is a perspective view illustrating a surrounding area of a toe of a slope where mounting of a flexible film has been completed.
Figure 4A:
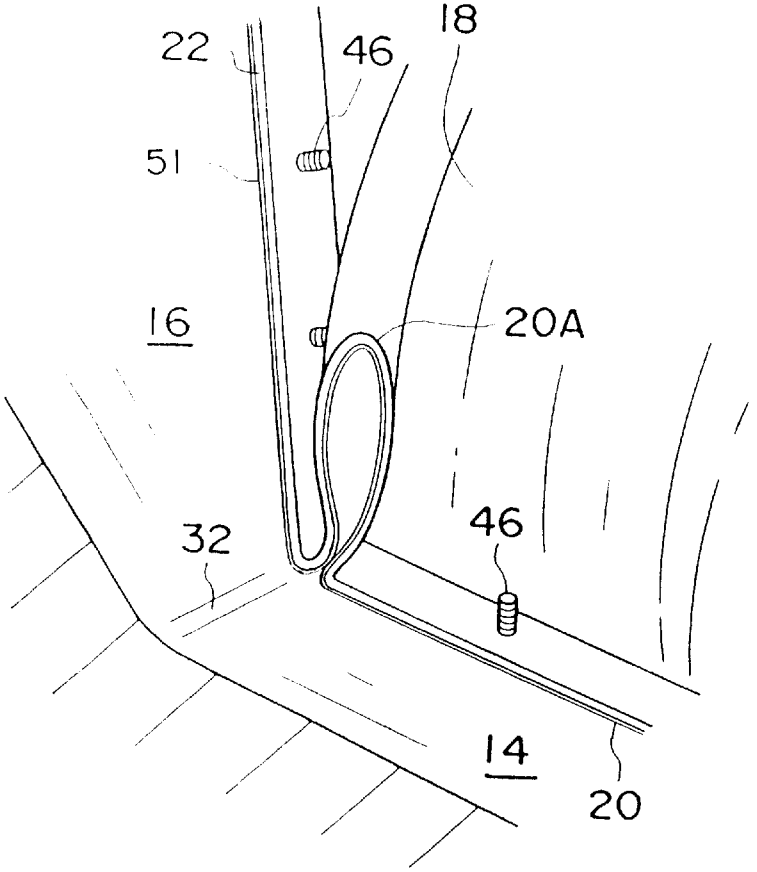
FIG. 4A is a perspective view illustrating a surrounding area of a toe of a slope where a flexible film is being mounted.

Here, 20A, a part that corresponds to the length l of the straight line edge 20 of the flexible film 18 shown in FIG. 3 goes beyond the straight line edge fixing line 30 and is left as a redundant portion which can not be mounted on the river bed 14 and the face of slope 16 as shown in FIG. 4A. As shown in FIG. 4B or FIGS. 8 through 10, the redundant portion is overlapped and folded with a sealing sheet 51 around the toe of slope 32 so that it is fixed on the river bed 14 and the face of slope 16 with fittings 52 which will be described later. The details of the fixed portion will also be given later.

The height H at the river bed 14 when the flexible film weir 10 is erected by supplying air inside is determined by the difference between the length W1 and the length W2. Then, the height of the connecting portion fixing line 26 is determined in such a way that the height H is almost constant across the entire length of the flexible weir 10.

Figure 7:
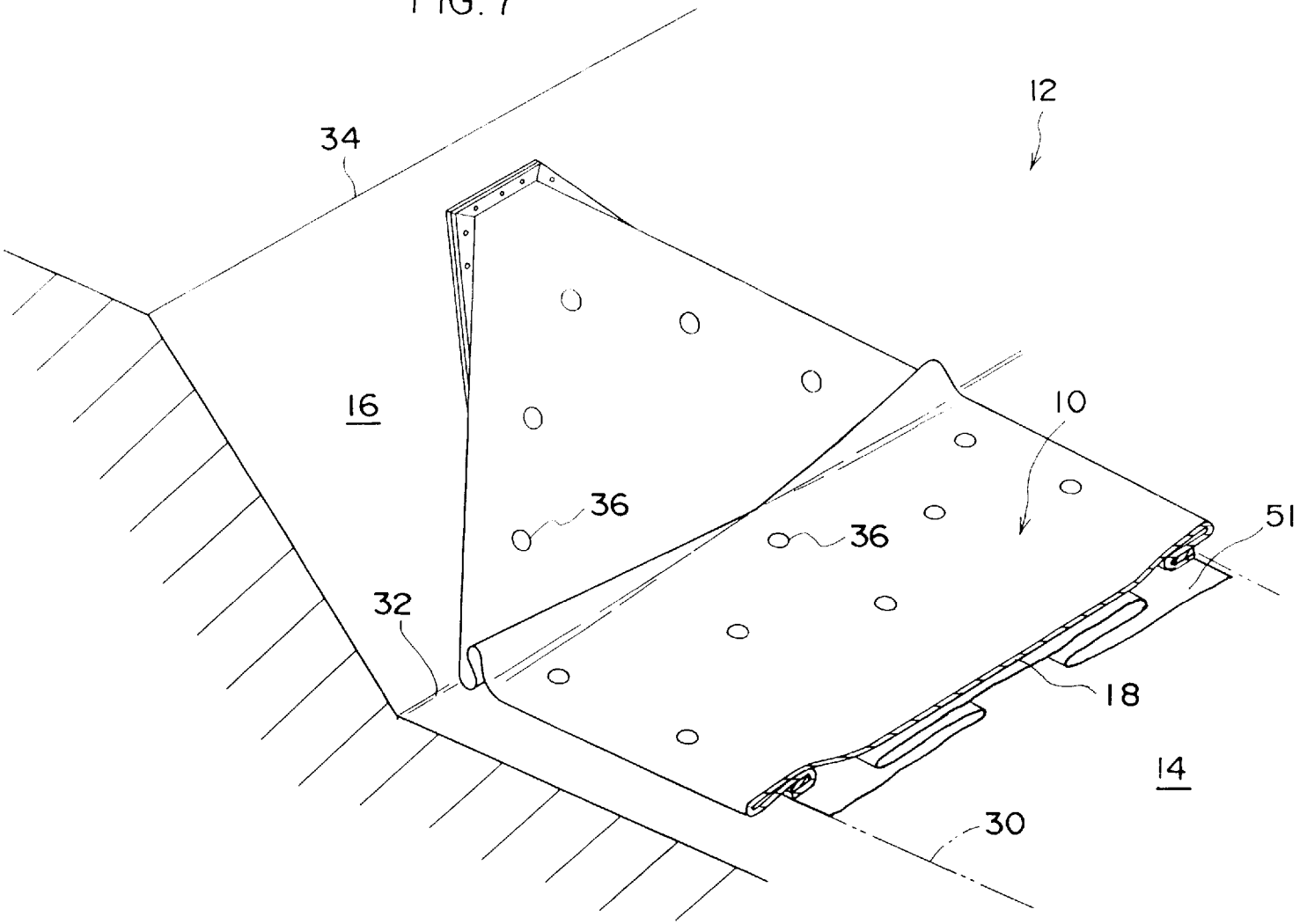
FIG. 7 is a perspective view illustrating part of a flexible film having been laid flat.
Figure 8:
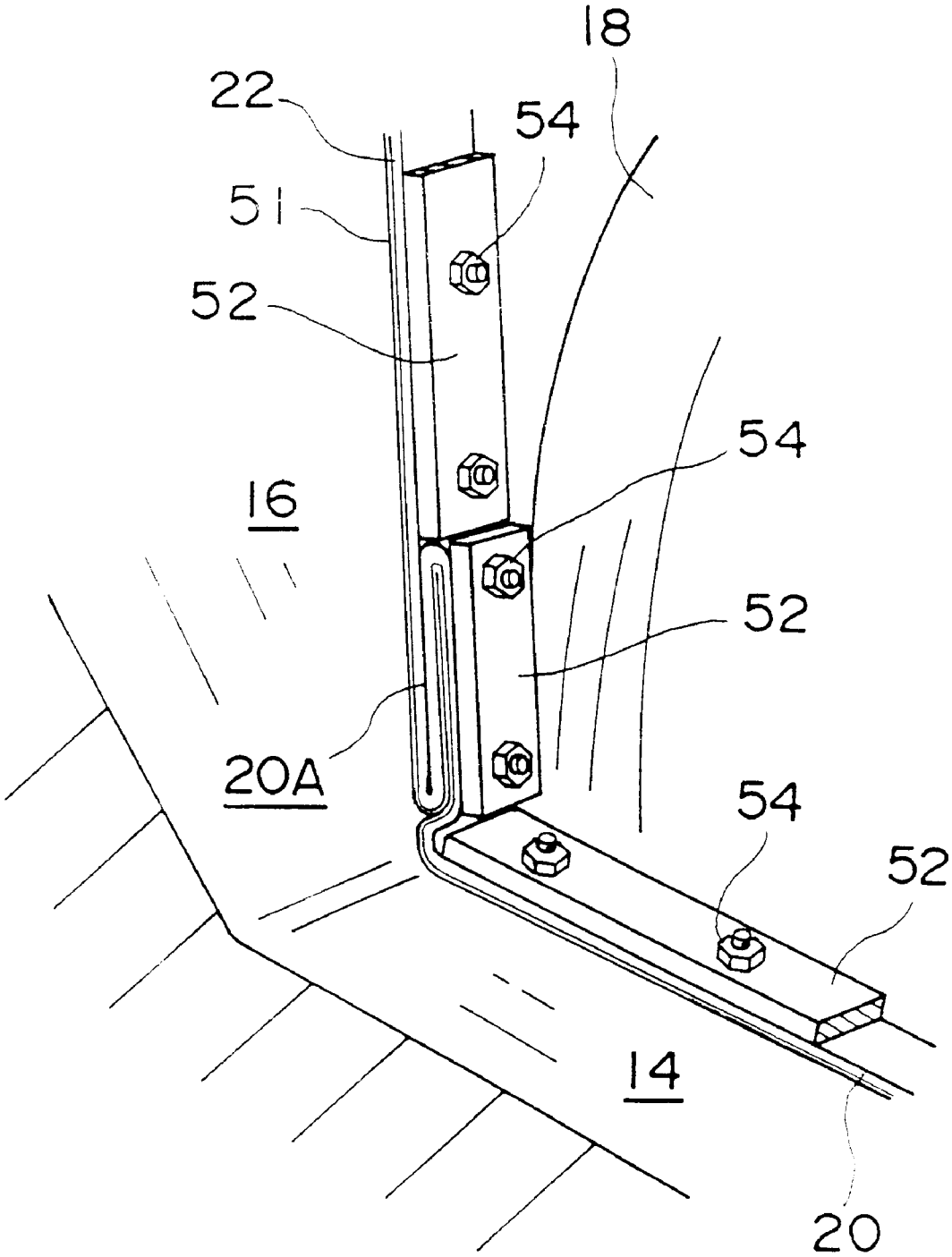
FIG. 8 is a perspective view illustrating another mounting embodiment of the surrounding area of the toe of slope of the flexible film.
Figure 9:
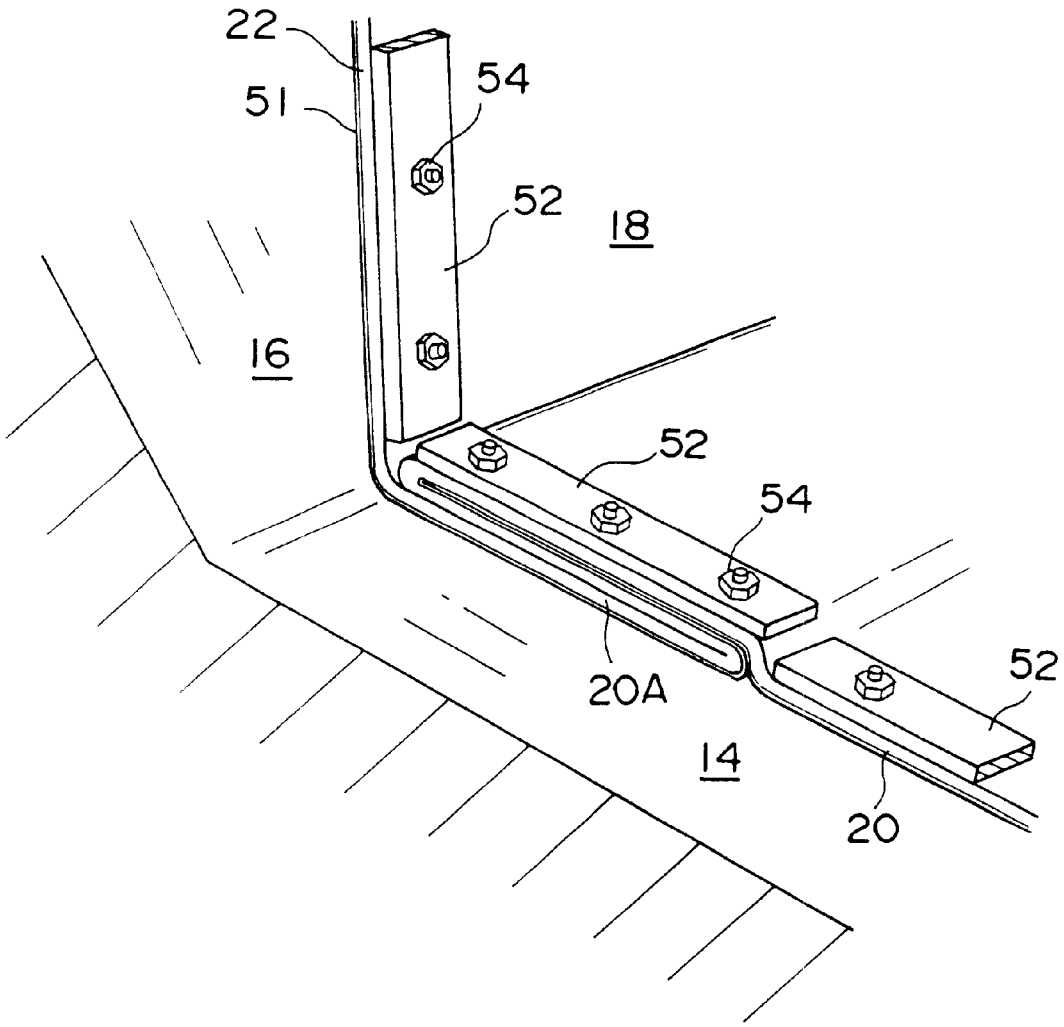
FIG. 9 is a perspective view illustrating a further mounting embodiment of the surrounding area of the toe of slope of the flexible film.
Figure 10:
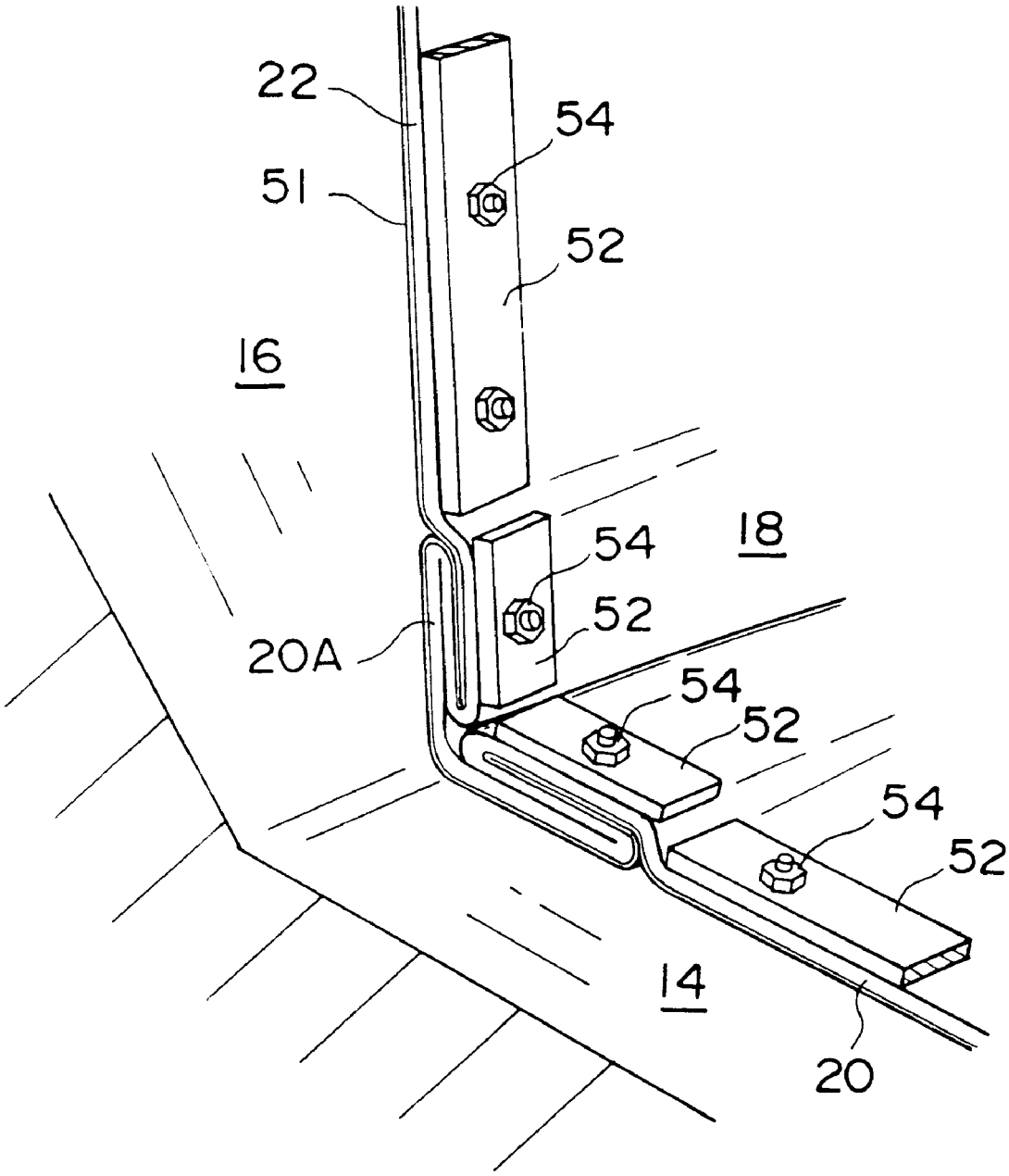
FIG. 10 is a perspective view illustrating a still further mounting embodiment of the surrounding area of the toe of slope of the flexible film.

As shown in FIGS. 1, 2 and 7, weights 36 are mounted on the flexible film 18 at appropriate intervals. The weights 36 are preferably made of metal with a heavier specific gravity than the flexible film 18, for example, metal such as stainless steel which cannot be easily corroded or resin-coated metal. It is also preferable that the specific gravity of the flexible film 18 including the weights 36 is not less than 1.5.

Figure 5:
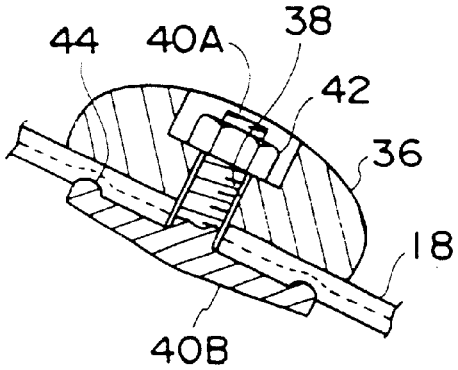
FIG. 5 is a cross-sectional view illustrating a weight mounted on a flexible film.

As shown in FIG. 5, a hole 38 is formed in the weight 36 so that the weight 36 is mounted on the flexible film 18 by engaging a nut 42 with a threaded portion 40A of a flanged bolt which penetrates the flexible film 18 from inside. Annular protruding portions 44 are formed integrally with a flange 40B of the flanged bolt to enhance contact with the flexible film 18.

Figure 6:
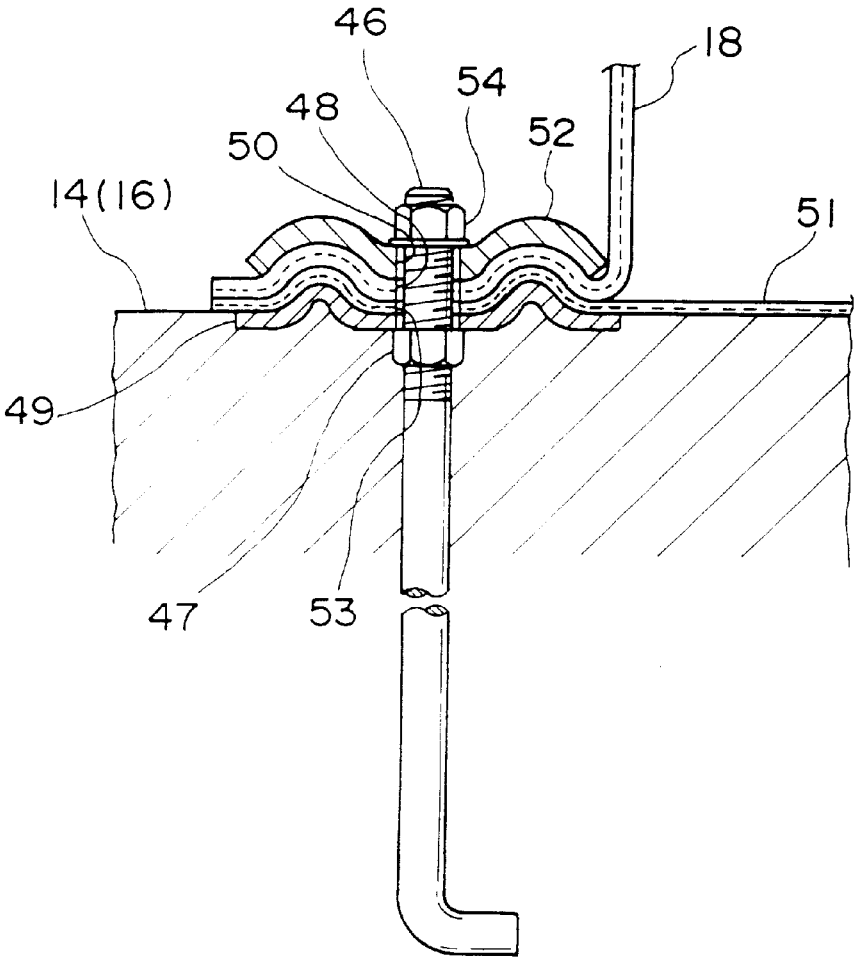
FIG. 6 is a cross-sectional view illustrating a mounting structure of a flexible film.

Next, a structure of the fixed portion of the flexible film 18 will be described in detail. Anchor bolts 46 are fitted along the connecting portion fixing lines 26, the inclining edge fixing lines 28 and the straight line edge fixing lines 30. As shown in FIG. 6, in the middle part of the anchor bolt 46, a nut 47 and an embedded metal fitting 49 are fitted.

As shown in FIGS. 2 and 6, a sealing sheet 51, which water and air cannot permeate and which is thinner than the flexible film 18, is laid on the river bed 14 and the faces of slopes 16.

Bolt holes 53 through which the anchor bolts 46 are inserted are formed in the positions corresponding to said anchor bolts 46 near the periphery of the sealing sheet 51. Bolt holes 48 through which the anchor bolts 46 are inserted are formed in the positions corresponding to said anchor bolts 46 near the periphery of the flexible film l8.

The inside is sealed when the surrounding area of the periphery of the sealing sheet 51 and the surrounding area of the periphery of the flexible film 18 are nipped and fixed between the embedded metal fittings 49 and the mounting metal fittings 52 by inserting the anchor bolts 46 into the corresponding bolt holes 53 and bolt holes 48, nipping the periphery of the flexible film 18 between the mounting metal fittings 52 in which the bolt holes 50 are formed and the sealing sheet 51 laid on the river bed 14 and the faces of slope 16, and engaging the nuts 54 with the anchor bolts 46 and tightening them.

The sealing sheet 51 may be any size (external configuration) as long as the surrounding area of the periphery of the sealing sheet 51 can be brought into close contact with the surrounding area of the periphery of the flexible film 18. The sealing sheet 51 of the present embodiment is set at the same size as the flexible film 18 shown in FIG. 3, and its two-dimensional configuration like the flexible film 18 allows easy manufacturing.

When air is supplied to the inside of the flexible film weir 10 that is fixed in the aforementioned manner (that is, between the flexible film 18 and the sealing seat 51), the flexible film weir 10 is erected with a certain height as shown in FIGS. 1 and 2. On the upper side of the toe of slope 32, part of the flexible film 18 is overlapped and makes a substantially band-like configuration, which absorb redundancies generated by the differences in the configuration when the weir is laid flat and when the weir is erected, as shown in FIGS. 1, 2, by arrows A.

In the flexible film weir 10 of the present embodiment, the flexible film 18 and the sealing sheet 51 form a bag-like body with superior airtightness. Thus, prevention of leakage of air can be ensured because air is supplied to the inside of the bag-like body.

Subsequently, when air is discharged from the inside of the flexible film weir 10, the whole flexible film 18 comes in close contact with the river bed 14 and the faces of slopes 16 as shown in FIG. 7.

Further, in the flexible film weir 10 of the present embodiment, as the weight of the weights 36 effects the increased specific gravity, the whole flexible film weir can be surely brought into close contact with the river bed 14 and the faces of slopes 16 even when some air is still left inside. Moreover, there is no need to execute large-scale construction work on site, such as forming the river bed 14 into an irregular configuration or fixing irregularity forming objects to the river bed 14. Thus, the overall cost can be reduced.

In the flexible film weir 10 of the present embodiment, the inclining edges 22 are inclined toward the apexes of slopes. Therefore, there is no excessive periphery length and the redundancies generated when the weir is erected and laid flat are small, which makes the appearance preferable. Further, as the radius of curvature can be short, the tension of the bag-like body is low, which provides safety.

The embodiment described above illustrates an example where the flexible film weir 10 is used for the river. However, the flexible film weir 10 of the present embodiment can also be used as a water gate or a weir for protecting a lake.

In the above embodiment, the inside is sealed by nipping the surrounding area of the periphery of the sealing sheet 51 and the surrounding area of the periphery of the flexible film 18 between the embedded metal fittings 49 and the mounting metal fittings 52. However, in order to enhance reliability, the surrounding area of the periphery of the sealing sheet 51 and the surrounding area of the periphery of the flexible film 18 may be bonded on the construction site.

Further, in the above embodiment, the surrounding area of the periphery of the sealing sheet 51 is brought into close contact with the surrounding area of the periphery of the flexible film 18 with the embedded metal fittings 49 and the mounting metal fittings 52 on the construction site. However, the surrounding area of the periphery of the sealing sheet 51 may be bonded with the surrounding area of the periphery of the flexible film 18 in the manufacturing plant so that an airtightness test may be conducted in advance. Thus, the bonding work and the confirmatory test of airtightness, etc. on the construction site can be obviated, thereby improving work efficiency.

What is claimed is:

1. A flexible film weir consisting of a flexible film, which is mounted on a bottom face and on faces of slopes situated on both sides of the bottom face, extends transversely from one slope face to the other slope face, and is erected and laid flat as fluid is supplied thereto and discharge d therefrom, characterized in that:

said flexible film has a two-dimensional configuration when expanded as a plane, and the total length of the periphery of said flexible film is set longer than the length of mounting portions of the bottom face and faces of slopes; and portions that are left redundant when said flexible film is mounted on said mounting portions are folded and fixed at the toes of the slopes, located where the bottom face meets the faces of the slopes, in such a way that the redundant portions are overlapped.

2. A flexible film weir according to claim 1, characterized in that weights with a heavier specific gravity than said flexible film are attached thereto, and wherein the weights are secured to the outside surface of the flexible film.

3. A flexible film weir according to claim 2, characterized in that the specific gravity of said flexible film including said weights is not less than 1.5.

4. A flexible film weir according to claim 3, characterized in that a sealing sheet which has the same configuration as said flexible film and is thinner than said flexible film is disposed between the bottom face and said flexible film and between the faces of slopes and said flexible film, so that the surrounding area of the periphery of said sealing sheet is in close contact with that of the periphery of said flexible film.

5. A flexible film weir according to claim 4, characterized in that the surrounding area of the periphery of said sealing sheet and the surrounding area of the periphery of said flexible film are nipped between the bottom face and metal fittings and between the faces of slopes and the metal fitting.

6. A flexible film weir according to claim 2, wherein the weights are attached to the film by a flanged bolt which penetrates through the film and into each weight; and the flange portion of the bolt includes a raised portion around its periphery which is in contact with the film.

7. A flexible film weir according to claim 2, wherein the weights have a circular shape.

8. A flexible film weir according to claim 1, characterized in that a sealing sheet which has the same configuration as said flexible film and is thinner than said flexible film is disposed between the bottom face and said flexible film and between the faces of the slopes and said flexible film, so that the surrounding area of the periphery of said sealing sheet is in close contact with that of the periphery of said flexible film.

9. A flexible film weir according to claim 8, characterized in that the surrounding area of the periphery of said sealing sheet and the surrounding area of the periphery of said flexible film are nipped between the bottom face and metal fittings and between the faces of the slopes and the metal fittings.

10. A flexible film weir according to claim 1, characterized in that weights with a heavier specific gravity than said flexible film are attached thereto, and further including a flanged bolt which penetrates through the film and into each weight mounting the weights to the flexible film.

11. A flexible film weir consisting of a flexible film, which is mounted on a bottom face and on faces of slopes situated on both sides of the bottom face, extends transversely from one slope face to the other slope face, and is erected and laid flat as fluid is supplied thereto and discharged therefrom, comprising:

said flexible film whose configuration at the time of expansion is two dimensional; a pair of first mounting edges on the bottom face which are aligned parallel to each other; and a pair of second mounting edges on the faces of the slopes whose ends are connected to ends of the pair of first mounting edges and the opposite ends are directly or indirectly connected to each other, characterized in that:

said pair of second mounting edges are mounted along a pair of second lines which are provided on the faces of the slopes, each of said second lines set with a same length as said second mounting edges when said flexible film is disposed on a plane, and wherein the second lines have ends coincident with ends of the second mounting edges, which are opposite to ends connected to the first mounting edges near the bottom face, and wherein the angle subtended by the second lines from where the second lines coincide with the second mounting edges is smaller than the angle subtended by said pair of second mounting edges; and said pair of first mounting edges are mounted along a pair of first lines which are provided on said bottom face, each of which is set by extending to a point of intersection with said second mounting edge when said flexible film is disposed on a plane, the length of said pair of first lines being shorter than the length of said pair of first mounting edges and extending in parallel with each other in the transverse direction so that redundant portions of said first mounting edges which go beyond said pair of first lines are converged and mounted around the toes of the slopes, located where the bottom face meets the faces of the slopes, in such a way that the redundant portions are overlapped.

12. A flexible film weir according to claim 11, characterized in that said pair of second mounting edges are inclined in such a way that the end portions opposite to those connected to the first mounting edges approach each other.

13. A flexible film weir according to claim 12, characterized in that weights with a heavier specific gravity than said flexible film are attached thereto, and wherein the weights are secured to the outside surface of the flexible film.

14. A flexible film weir according to claim 13, characterized in that the specific gravity of said flexible film including said weights is not less than 1.5.

15. A flexible film weir according to claim 14, characterized in that a sealing sheet which has the same configuration as said flexible film and is thinner than said flexible film is disposed between the bottom face and said flexible film and between the faces of the slopes and said flexible film so that the surrounding area of the periphery of said sealing sheet is in close contact with that of the periphery of said flexible film.

16. A flexible film weir according to claim 15, characterized in that the surrounding area of the periphery of said sealing sheet and the surrounding area of the periphery of said flexible film are nipped between the bottom face and metal fittings and between the faces of the slopes and the metal fittings.

17. A flexible film weir according to claim 12, characterized in that weights with a heavier specific gravity than said flexible film are attached thereto, and further including a flanged bolt which penetrates through the film and into each weight mounting the weights to the flexible film.

18. A flexible film weir according to claim 13, wherein the weights are attached to the film by a flanged bolt which penetrates through the film and into each weight; and the flange portion of the bolt includes a raised portion around its periphery which is in contact with the film.

19. A flexible film weir according to claim 13, wherein the weights have a circular shape.

* * * * *